US007744398B1

(12) United States Patent
Wilkolaski et al.

(10) Patent No.: US 7,744,398 B1
(45) Date of Patent: Jun. 29, 2010

(54) LOCKING DEVICE FOR AN ELECTRICAL CONNECTOR

(75) Inventors: Edward A. Wilkolaski, Lancaster, NY (US); Christopher P. Camacho, Derby, NY (US)

(73) Assignee: Curbell Electronics Inc., Orchard Park, NY (US)

( * ) Notice: Subject to any disclaimer, the term of this patent is extended or adjusted under 35 U.S.C. 154(b) by 0 days.

(21) Appl. No.: 12/362,135

(22) Filed: Jan. 29, 2009

(51) Int. Cl.
*H01R 13/627* (2006.01)

(52) U.S. Cl. ..... 439/357; 439/358

(58) Field of Classification Search ..... 439/357, 439/355, 358, 368, 79, 77, 80
See application file for complete search history.

(56) References Cited

U.S. PATENT DOCUMENTS 4,418,976 A * 12/1983 Lenzini et al. ..... 439/358
4,509,813 A * 4/1985 Hesse ..... 439/347
5,151,034 A * 9/1992 Chandler et al. ..... 439/79
5,316,489 A * 5/1994 Kachlic et al. ..... 439/79

* cited by examiner

*Primary Examiner*—Michael C Zarroli
(74) *Attorney, Agent, or Firm*—Hodgson Russ LLP

(57) ABSTRACT

A low-profile locking clip is installable on a surface-mount header of a printed circuit board to secure one or more inserted plug connectors in mating engagement with the surface-mount header to prevent unintended loosening and disconnection. The locking clip comprises a plurality of catch members that engage with respective lead pins of the surface-mount header and a top wall that includes one or more recesses for receiving a detent tab on a corresponding plug connector to prevent withdrawal of the plug connector.

14 Claims, 3 Drawing Sheets

LOCKING DEVICE FOR AN ELECTRICAL CONNECTOR

FIELD OF THE INVENTION

The present invention is generally directed to electronic connectors, and more specifically to securing the connection of a surface-mount header on a printed circuit board with one or more mated plug connectors.

BACKGROUND OF THE INVENTION

Many electronic power or communication devices need to transmit power or communication signals between a printed circuit board (PCB) to a separate electronic device. In many cases, this electrical connection needs to be removed and re-applied at a later date. For example, in a hospital pillow speaker, a PCB mounted inside the device housing may have a cable connected to it. This cable may carry power and/or communication signals necessary for the pillow speaker to operate properly. As the pillow speaker nears end of life, or if it needs repair or service, the pillow speaker may need to be opened and the cable disconnected from the PCB. A plug connector is commonly used so that the cable can be easily removed from the PCB and easily reconnected to the PCB. Furthermore, the use of a plug connector allows an electrical connection to be made without having to attach the cable to the PCB in a way that may potentially damage the PCB. One drawback to this method is that the plug connector at the end of the cable can sometimes loosen from mated engagement and become disconnected from the PCB connection header, resulting in device failure or improper operation. To help prevent this from occurring, many PCB connection headers use a "shrouded" connector having a notch that allows the plug connector at the end of the cable to snap into place. This creates a mechanical lock for the mating header and plug connector as well as an electrical connection.

Prior art locking connector designs typically require the locking device to be part of the PCB connection header. These devices typically do not allow for a low profile locking connection, as the shrouded header is typically high and consumes a lot of space. These devices are generally incompatible with surface-mount technology (SMT) PCB connectors.

SUMMARY OF THE INVENTION

The present invention provides a locking device for securing a surface-mount header and at least one plug connector in mating engagement with one another. The locking device may be embodied as a low-profile locking clip that installs on a surface-mount header and secures one or more plug connectors in mating engagement with the surface-mount header. Where more than one plug connector mates with a single surface-mount header, the invention provides a key for ensuring that each plug connector is mated at its proper pin location on the surface-mount header.

A locking clip of the present invention comprises a top wall including a recess for each plug connector, a rear wall extending downwardly from the top wall, and a pair of laterally spaced side walls extending downwardly from the top wall, each side wall being spaced from the rear wall to define a respective side opening between the side wall and the rear wall. The locking clip additionally comprises a plurality of laterally spaced catch members extending downwardly from the top wall and aligned with the pair of side openings, each catch member having an upwardly facing catch surface. The catch surfaces of the plurality of catch members are open in forward and rearward directions and in a direction toward one of the pair of side openings. The rear wall engages a rear portion of the surface-mount header to restrict forward displacement of the locking clip, the pair of side walls engage opposite sides of the plug connector or group of plug connectors to restrict lateral displacement of the locking clip, and the plurality of catch members each engage a corresponding lead pin of the surface-mount header to restrict upward displacement of the locking clip. Each recess of the top wall receives a detent tab of a respective plug connector to prevent separation of the at least one plug connector from the surface-mount header. Where a group of plug connectors mate with one surface-mount header, the recesses may be laterally spaced to align with the detent tab of a corresponding plug connector only if the plug connector is at the proper pin location on the surface-mount header. An undersurface of the top wall may have a beveled portion adjacent a front edge of the top wall to facilitate insertion of a plug connector into mating and locked engagement with the surface mount-header.

The invention extends to an assembly comprising a locking clip as summarized above in combination with a PCB including a surface-mount header and at least one plug connector mated therewith.

The invention also covers a method for securing a surface-mount header and a plug connector in mating engagement with one another comprising the steps of (i) installing a locking clip onto the surface-mount header, wherein the locking clip includes at least one catch member engaging a corresponding lead pin of the surface-mount header, and (ii) mating a plug connector with the surface-mount header, wherein the locking clip includes a recess receiving a detent tab of the plug connector.

DETAILED DESCRIPTION OF THE INVENTION

Figure 1:
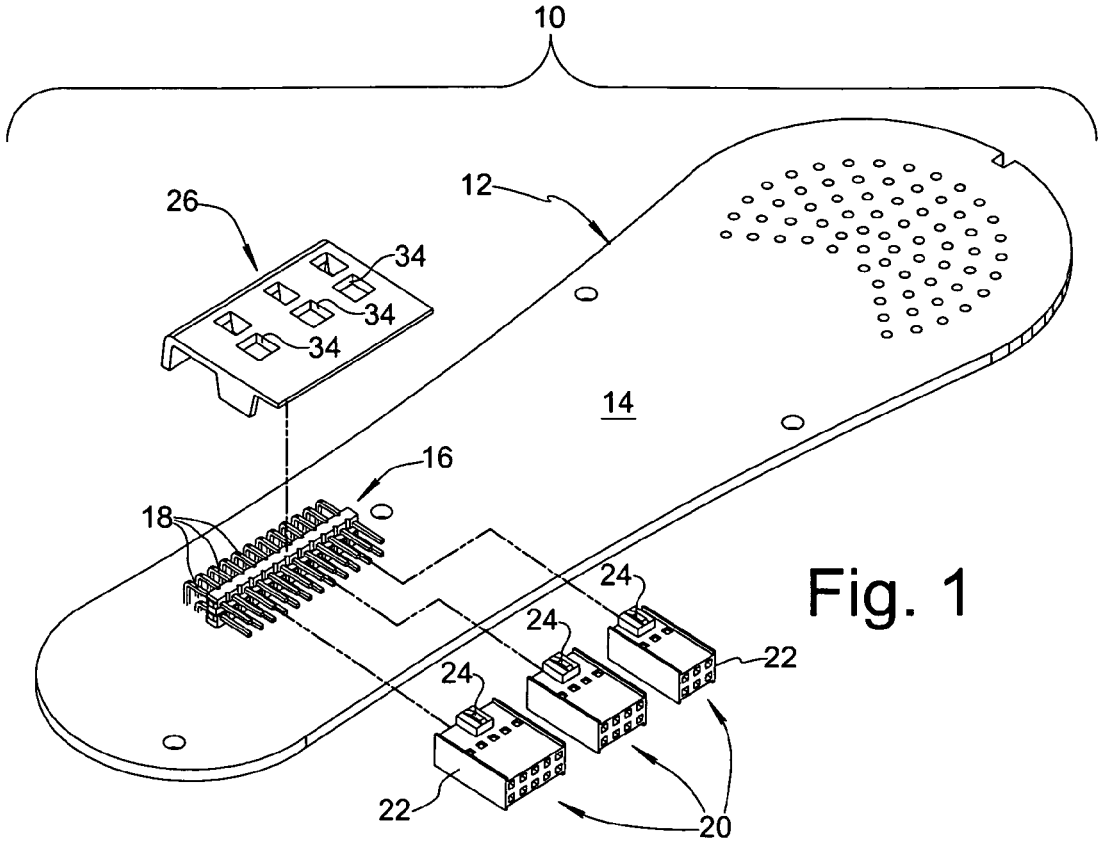
FIG. 1 is an exploded perspective view of an assembly including a locking clip formed in accordance with a first embodiment of the present invention.
Figure 2:
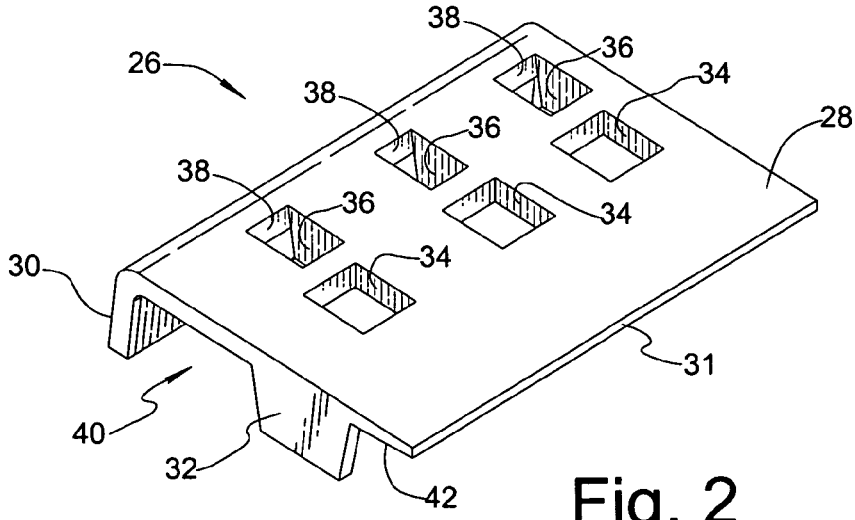
FIG. 2 is an enlarged perspective view of the locking clip shown in FIG. 1.
Figure 3:
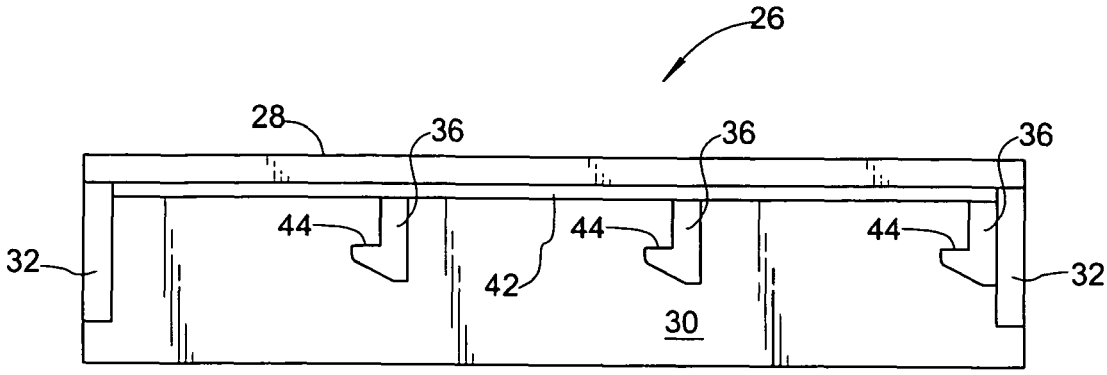
FIG. 3 is a front elevational view thereof.

FIG. 1 shows an assembly 10 that embodies the present invention. Assembly 10 comprises a printed circuit board (PCB) 12 having a surface 14 and a surface-mount header 16 by which a cable (not shown) conducting electrical signals may be connected to circuitry on PCB 12. More particularly, surface-mount header 16 includes a plurality of conductive lead pins 18 soldered to surface 14 of PCB 12 for connection to plug connectors 20 at an end of the cable. As may be seen in FIG. 1, lead pins 18 may protrude from PCB surface 14 and bend to extend in a direction substantially parallel to PCB surface 14. Each plug connector 20 is configured to mate with surface-mount header 16 to electrically connect individual conductors within the cable to corresponding lead pins 18. The number of lead pins 18 in surface-mount header 16 and number of conductors associated with a given plug connector 20 is subject to variation. As shown, it is possible to have one or more than one plug connector 20 mated with a given surface-mount header 16. For example, in FIG. 1, surface-mount header 16 is a 24-pin header mating with three different plug connectors 20, including a 10-pin plug connector (leftmost), an 8-pin plug connector (middle), and a 6-pin plug connector (rightmost). Alternatively, surface mount header 16 may be configured and intended to mate with only one plug connector 20. The gender of surface-mount header 16 and plug connector(s) 20 may be interchangeable. In other words, surface-mount header 16 may have a male configuration and plug connector(s) 20 a mating female configuration, or surface-mount header 16 may have a female configuration and plug connector(s) 20 a mating male configuration. Each plug connector 20 includes opposite sides 22 and a detent tab 24.

Reference is made also now to FIGS. 2-5. In accordance with the present invention, assembly 10 further comprises a locking clip 26 that installs onto surface-mount header 16 and physically retains plug connectors 20 in mating engagement with surface mount-header 16. Locking clip 26 comprises a top wall 28 including one recess 34 for each plug connector 20, a rear wall 30 extending downwardly from the top wall, and a pair of laterally spaced side walls 32 extending downwardly from the top wall. Each side wall 32 may be spaced from rear wall 30 to define respective side openings 40 between side walls 32 and the rear wall 30 (only one side opening being visible in FIG. 2).

As will be described in greater detail below, each recess 34 is positioned and sized to receive the detent tab 24 of a corresponding plug connector. Recess 34 is recessed relative to an undersurface 29 of top wall 28, and may be embodied as an opening that extends entirely through top wall 28 to allow visual verification that detent tab 24 has been received in the recess.

Figure 4:
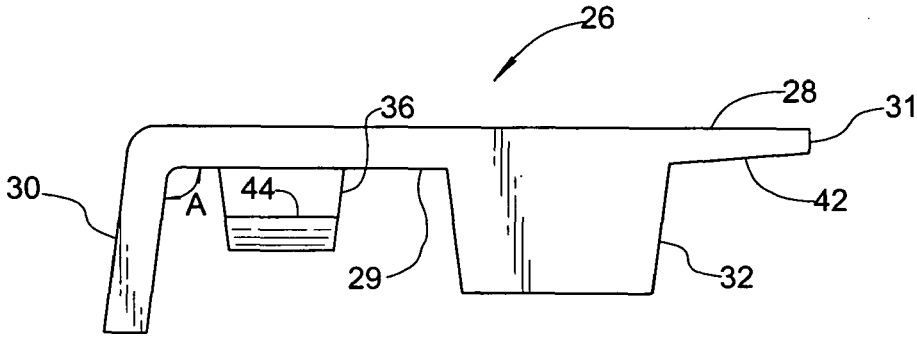
FIG. 4 is a side elevational view thereof.

Locking clip 26 also includes a plurality of laterally spaced catch members 36 extending downwardly from top wall 28 and aligned with the pair of side openings 40, whereby catch members 36 are visible in a side view such as FIG. 4. Each catch member 36 has an upwardly facing catch surface 44 that is open in forward and rearward directions and in the same lateral direction toward one of the pair of side openings. For example, as may be seen in FIGS. 3, catch surfaces 44 are open toward the left side of locking clip 26 and closed toward the right side of locking clip 26 by the vertical portion of the catch member. As best seen in FIG. 4, catch surfaces 44 are open in forward and rearward directions of locking clip 26. Top wall 28 may include a plurality of through-holes 38, each through-hole 38 being located overtop a respective one of the plurality of catch surfaces 44.

Figure 5:
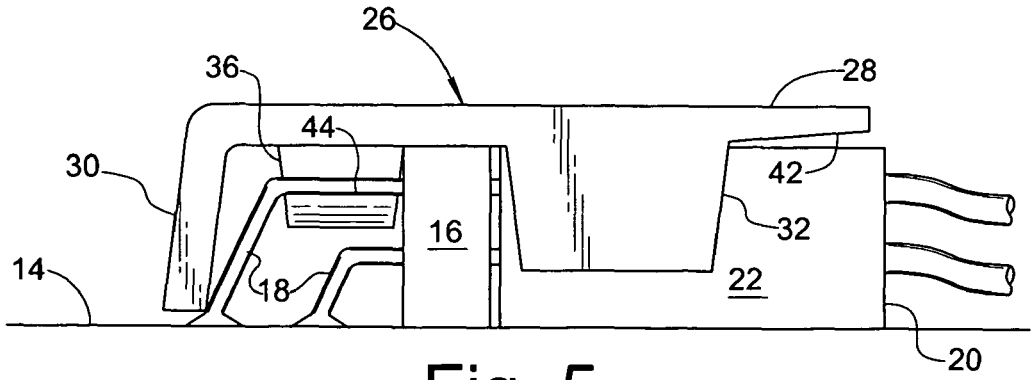
FIG. 5 is a side elevational view of the locking clip installed on a surface-mount header and a plug connector mated with the surface-mount header.
Figure 6:
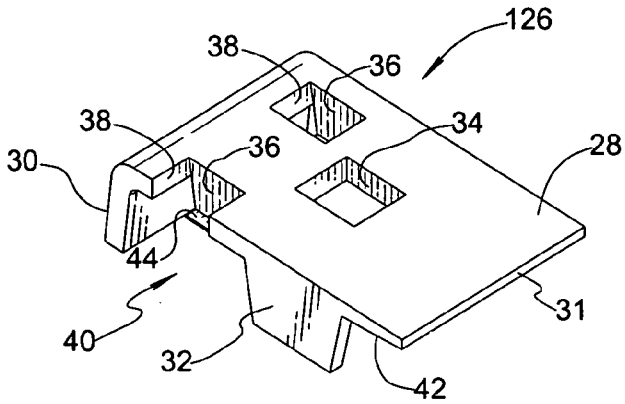
FIG. 6 is an enlarged perspective view of a locking clip formed in accordance with a second embodiment of the present invention.
Figure 7:
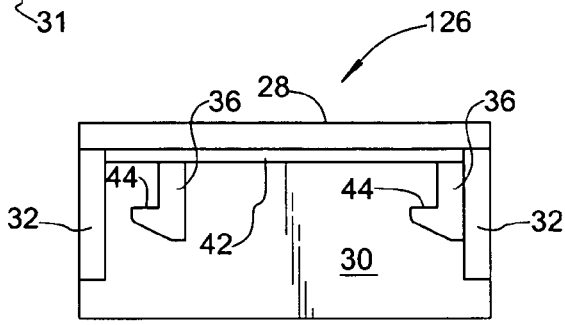
FIG. 7 is a front elevational view of the locking clip shown in FIG. 6.
Figure 8:
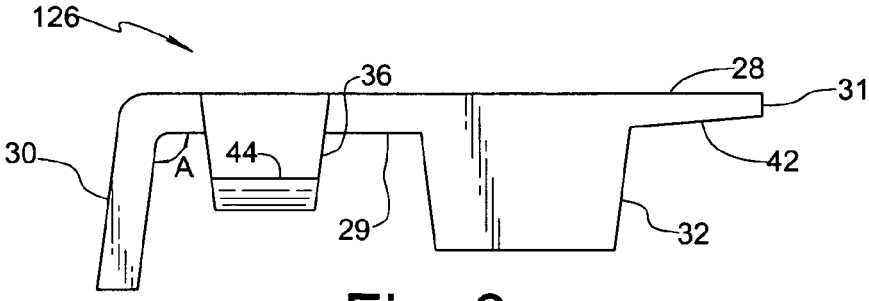
FIG. 8 is a side elevational view thereof.
Figure 9:
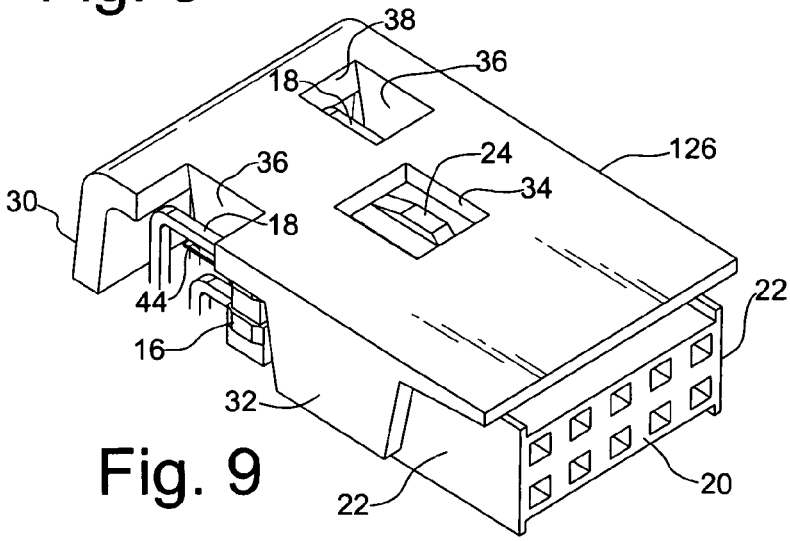
FIG. 9 is a perspective view of the locking clip of the second embodiment installed on a surface-mount header and a plug connector mated with the surface-mount header.

The undersurface 29 of top wall 28 may have a beveled portion 42 adjacent a front edge 31 of the top wall, as best seen in FIGS. 4 and 5. Rear wall 30 may form a slightly obtuse angle "A" with top wall 28 as illustrated in FIG. 4.

Locking clip 26 may be economically formed as a molded plastic unit, however other materials and manufacturing methods may be employed without straying from the invention.

Use of locking clip 26 in conjunction with surface-mount header 16 and plug connectors 20 will now be described. Before plug connectors 20 are mated with surface-mount header 16, locking clip 26 is installed onto surface-mount header 16 by moving the locking clip forwardly and slightly laterally until each catch member 36 engages a corresponding lead pin 18 and rear wall 30 abuts against a rear portion of surface-mount header 16 where lead pins 18 extend upwardly from solder points on PCB surface 14. Once locking clip is installed on surface-mount header 16, each plug connector 20 is mated with surface-mount header 16 at its proper pin location by inserting the plug connector in a rearward direction until its detent tab 24 is received in an aligned recess 34 of locking clip 26. As a plug connector 20 is inserted, its detent tab will engage beveled portion 42 of undersurface 29, thereby deflecting top wall 28 away from PCB surface 14 until detent tab 24 is fully received in recess 34, at which point top wall 28 will snap back toward PCB surface 14 and withdrawal of plug connector 20 is prevented. Each plug connector 20 is inserted in a similar manner. Recesses 34 of locking clip 26 may be positioned laterally on the locking clip to align with the detent tabs 24 of plug connectors 20 when the plug connectors are properly arranged on surface-mount header 16. If a user attempts to insert a plug connector 20 at the wrong location on surface-mount header 16, then the corresponding recess 34 will not be aligned with detent tab 24 of the plug connector and top wall 28 of locking clip 26 will not be allowed to snap back into place. In this way, locking clip 26 of the present invention acts as a "key" to ensure proper arrangement of plug connectors 20.

When locking clip 26 is properly installed in accordance with FIG. 5, rear wall 30 extends from top wall 28 toward PCB surface 14 and engages lead pins 18 at a rear portion of the surface-mount header, thereby restricting forward displacement of locking clip 26. Side walls 32 of locking clip extend from top wall 28 toward board surface 14 to engage opposite sides of the plurality of plug connectors 20. Where a plurality of plug connectors 20 are arranged side-by-side as shown in FIG. 1, side walls 32 will engage the exposed side 22 of the leftmost plug connector and the exposed side 22 of the rightmost plug connector to restrict lateral displacement of the locking clip. In the second embodiment described below, wherein only one plug connector 20 is mated and secured, side walls 32 will engage opposite sides of the same plug connector to restrict lateral displacement of the locking clip. As may be understood, when locking clip 26 is properly installed, each catch surface 44 is positioned directly under the associated lead wire 18 as shown in FIG. 5 to prevent upwardly directed removal of locking clip 26.

In order to remove locking clip 26 from locking engagement with surface-mount header 16 and plug connectors 20, it is first necessary to withdraw plug connectors 20 by prying the front portion of top wall 28 away from PCB surface 14 enough so that detent tab 24 is no longer captured by recess 34, and then pulling the plug connector away from surface-mount header 16. Prying top wall 28 may be accomplished manually by reaching into the gap between beveled portion 42 and the top of plug connector 20 with a finger or a tool, for example a screwdriver.

FIGS. 6-9 show a second embodiment of the present invention, wherein a locking clip 126 is designed for use in securing a single plug connector 20 in mated engagement with a corresponding surface-mount header 16. Locking clip 126 is generally similar to locking clip 26 in its construction and use, however locking clip 126 is narrower side-to-side, has only one recess 34, and fewer catch members 36. As mentioned above, side walls 32 engage opposite sides 22 of single plug connector 20 to restrict lateral displacement of locking clip 126.

Modifications and other embodiments of the invention set forth herein will be apparent to one skilled in the art to which the invention pertains in light of teachings presented in the present specification. Therefore, the invention is not to be limited to the specific embodiments disclosed, and modifications and other embodiments are intended to be included within the scope of the appended claims.

PARTS LIST

10 Assembly
12 Printed circuit board (PCB)
14 Surface of PCB
16 Surface-mount header
18 Lead pins
20 Plug connector
22 Side of plug connector
24 Detent tab of plug connector
26 Locking clip
28 Top wall of locking clip
29 Undersurface of top wall
30 Rear wall of locking clip
31 Front edge of top wall
32 Side wall of locking clip
34 Recess
36 Catch member
38 Through-hole
40 Side opening
42 Beveled portion of undersurface
44 Catch surface of catch member

What is claimed is:

1. A locking clip for securing a surface-mount header and at least one plug connector in mating engagement with one another, each plug connector including a detent tab, the locking clip comprising:

a top wall including a recess for each plug connector;

a rear wall extending downwardly from the top wall;

a pair of laterally spaced side walls extending downwardly from the top wall; and a plurality of laterally spaced catch members extending downwardly from the top wall, each catch member having an upwardly facing catch surface, the catch surfaces of the plurality of catch members being open in forward and rearward directions and in a same lateral direction;

wherein the rear wall engages a rear portion of the surface-mount header to restrict forward displacement of the locking clip, the pair of side walls engage opposite sides of the at least one plug connector to restrict lateral displacement of the locking clip, and the plurality of catch members each engage a corresponding lead pin of the surface-mount header to restrict upward displacement of the locking clip; and wherein each recess of the top wall receives the detent tab of a respective plug connector to prevent separation of the at least one plug connector from the surface-mount header.

2. The locking clip according to claim 1, wherein the top wall includes a plurality of recesses, and each of the plurality of recesses receives the detent tab of a corresponding one of a plurality of plug connectors.

3. The locking clip according to claim 2, wherein the plurality of recesses are laterally spaced to align with the detent tab of a respective plug connector only if the respective plug connector is properly located with respect to the surface-mount header.

4. The locking clip according to claim 1, wherein the recess is an opening through the top wall.

5. The locking clip according to claim 1, wherein the top wall further includes a plurality of through-holes, each through-hole being located overtop a respective one of the plurality of catch surfaces.

6. The locking clip according to claim 1, wherein the top wall includes an undersurface having a beveled portion adjacent a front edge of the top wall.

7. The locking clip according to claim 1, wherein each side wall is spaced from the rear wall to define a respective side opening between the side wall and the rear wall.

8. The locking clip according to claim 7, wherein the plurality of catch members are aligned with the pair of side openings, and the catch surfaces of the plurality of catch members are open toward one of the pair of side openings.

9. The locking clip according to claim 1, wherein the rear wall forms an obtuse angle with the top wall.

10. An assembly comprising:

a printed circuit board having a board surface;

a surface-mount header mounted on the board surface, the surface-mount header including a plurality of lead pins connected to the board surface and bent to extend parallel to the board surface;

a plug connector mated with the surface-mount header, the plug connector including a detent tab protruding away from the board surface;

a locking clip including a top wall parallel to the board surface, the top wall having a recess, wherein the detent tab of the plug connector is received in the recess;

the locking clip further including a rear wall extending from the top wall toward the board surface, wherein the rear wall engages a rear portion of the surface-mount header;

the locking clip further including a pair of laterally spaced side walls extending from the top wall toward the board surface, each side wall being spaced from the rear wall to define a respective side opening between the side tab and the rear wall, and a plurality of laterally spaced catch members extending from the top wall toward the board surface and aligned with the pair of side openings, each catch member having a catch surface facing away from the board surface, the catch surfaces of the plurality of catch members being open in forward and rearward directions and in a direction toward one of the pair of side openings, wherein the each of the catch surfaces engages a corresponding lead pin of the surface-mount header.

11. The assembly according to claim 10, wherein the pair of side walls engage opposite sides of the plug connector.

12. The assembly according to claim 10, wherein assembly comprises a plurality of plug connectors mated with the surface-mount header, each plug connector including a detent tab protruding away from the board surface, and the locking clip includes a plurality of recesses each receiving the detent tab of a respective one of the plurality of plug connectors, and the pair of side walls engage opposite sides of the plurality of plug connectors.

13. The assembly according to claim 12, wherein the plurality of recesses are laterally spaced to align with the detent tab of a respective plug connector only if the respective plug connector is properly located with respect to the surface-mount header.

14. A method for securing a surface-mount header and a plug connector in mating engagement with one another, the surface-mount header including a plurality of lead pins and the plug connector including a detent tab, the method comprising the steps of:

installing a locking clip onto the surface-mount header, wherein the locking clip includes at least one catch member engaging a corresponding lead pin of the surface-mount header; and mating the plug connector with the surface-mount header, wherein the locking clip includes a recess receiving the detent tab of the plug connector, wherein the step of mating a plug connector with the surface-mount header includes mating a plurality of plug connectors with the surface-mount header, wherein the locking clip includes a plurality of recesses respectively receiving the detent tab of a corresponding one of the plurality of plug connectors, wherein the plurality of recesses are laterally spaced to align with the detent tab of a corresponding plug connector only if the corresponding plug connector is properly located with respect to the surface-mount header.

* * * * *